US006679253B1

(12) United States Patent
Feng

(10) Patent No.: US 6,679,253 B1
(45) Date of Patent: Jan. 20, 2004

(54) AUTOMATIC WATER STOPPER FOR SNORKEL

(76) Inventor: Le-Jang Feng, 1 Fl., No. 22-10, Lane 50, Tien Mu E. Rd., Taipei (TW)

( * ) Notice: Subject to any disclaimer, the term of this patent is extended or adjusted under 35 U.S.C. 154(b) by 0 days.

(21) Appl. No.: 10/222,127

(22) Filed: Aug. 15, 2002

(51) Int. Cl.[7] ..... B63C 11/16

(52) U.S. Cl. ..... 128/201.11; 128/200.29; 128/201.27; 128/201.28

(58) Field of Search ..... 128/200.29, 201.11, 128/201.26, 201.27, 201.28, 201.29, 206.29; 405/186, 187; 181/127, 21

(56) References Cited

U.S. PATENT DOCUMENTS 4,805,610 A * 2/1989 Hunt ..... 128/201.11
5,117,817 A * 6/1992 Lin ..... 128/201.11
5,404,872 A * 4/1995 Choi ..... 128/201.11
5,529,057 A * 6/1996 Ferrero et al. ..... 128/201.11
6,073,626 A * 6/2000 Riffe ..... 128/201.11
6,371,108 B1 * 4/2002 Christianson ..... 128/201.11

* cited by examiner

*Primary Examiner*—Weilun Lo
*Assistant Examiner*—Michael Mendoza
(74) *Attorney, Agent, or Firm*—Pro-Techtor International Services

(57) ABSTRACT

An automatic water stopper for snorkel mainly includes from bottom to top a lower case having radially equally spaced upright air tubes, a float and a water-stopping diaphragm having corresponding radiated cross section, an air path disk, and an upper case. The air path disk includes a plurality of alternately arranged valve openings and air paths. The air paths are aligned with and therefore always communicable with the air tubes for air to flow into and out of the snorkel while the valve openings are closed or opened depending on positions of the float in the lower case. When the valve openings are opened, air flows into or out of the snorkel along a path defined by the valve openings, the air paths, and the air tubes. When the float contacts with water and moves upward to close the valve openings, external water is prevented from flowing into the snorkel.

9 Claims, 6 Drawing Sheets

AUTOMATIC WATER STOPPER FOR SNORKEL

BACKGROUND OF THE INVENTION

The present invention relates to an automatic water stopper for snorkel, and more particularly to a structurally strengthened automatic water stopper for connecting to a snorkel to provided good water-stopping function automatically.

A snorkel is one of many major diving apparatus for skin diving, and it enables a diver to see scenery under water while keep breathing smoothly.

A conventional snorkel is a substantially J-shaped hollow tube without any water-stopping means connected thereto. Therefore, a diver using the conventional snorkel tends to be choked with water flown into the snorkel via an open upper end thereof.

A conventional automatic water stopper has been developed for connecting to the upper end of the conventional snorkel and mainly includes an expanded case provided at the upper end of the snorkel. A one-way diaphragm valve, a cylindrical float, and other components are mounted in an inner space defined by the expanded case. When the float is in contact with water and lifted due to a buoyancy of the water, it upward touches the one-way diaphragm valve to automatically close the latter and thereby prevents water from flowing into the snorkel and protects a diver from being choked with water.

The above-described expanded case at the upper end of the snorkel for mounting the one-way diaphragm valve and the float is a hollow case without any rigid supporting means. When the snorkel with the conventional water stopper is stored along with other heavy diving apparatus, such as air tanks and lead weights, and is compressed by or collides with these heavy apparatus, it tends to be easily damaged or broken. Moreover, the expanded case provided at the upper end of the conventional snorkel tends to damage or break and becomes useless when the snorkel collides with rocks or reefs or is struck by big waves. And, a damaged snorkel is very dangerous to the diver and should be avoided.

SUMMARY OF THE INVENTION

It is therefore a primary object of the present invention to provide a structurally enhanced and functionally improved automatic water stopper for connecting to an upper end of a snorkel to ensure the safety of a diver using the snorkel.

To achieve the above and other objects, the automatic water stopper for snorkel according to the present invention mainly includes from bottom to top a lower case having radially equally spaced upright air tubes, a float and a water-stopping diaphragm having corresponding radiated cross section, an air path disk, an upper hood, and an upper case. The air path disk includes a plurality of alternately arranged valve openings and air paths. The air paths are always communicable with the air tubes and a hose connector on the lower case for air to flow into and out of the snorkel hose while the valve openings are closed or opened depending on positions of the float and the water-stopping diaphragm in the lower case. When the valve openings are opened, air flows into or out of the snorkel hose along a path defined by the valve openings, the air paths, and the air tubes. When the float is in contact with water and moves upward due to a buoyancy of the water to close the valve openings, external water is prevented from flowing into the snorkel hose and accordingly a user's mouth. The radially spaced air tubes also strengthen the lower case to avoid easy breaking thereof due to collision with other things.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
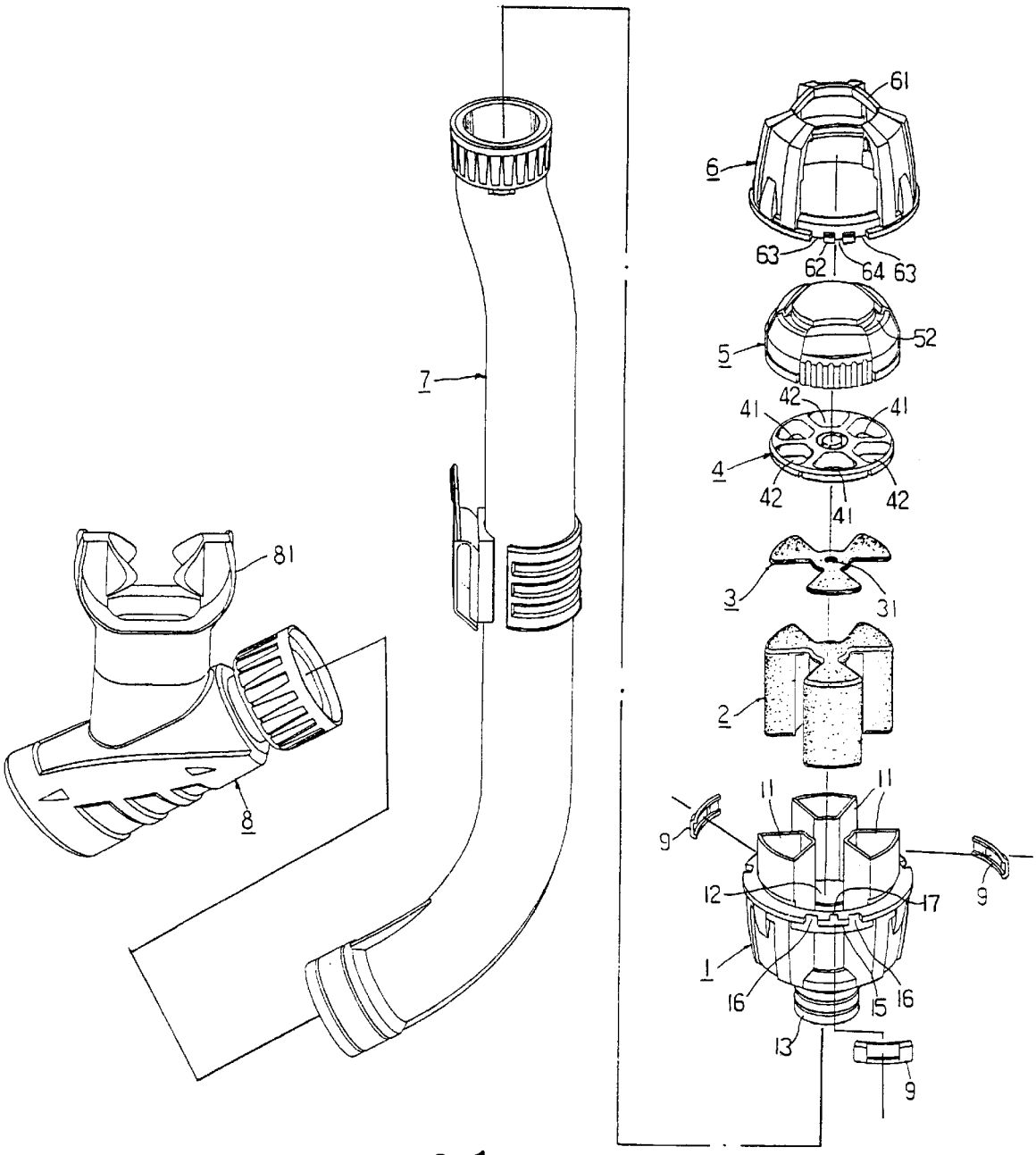
FIG. 1 is an exploded perspective view of an automatic water stopper for snorkel according to the present invention.
Figure 2:
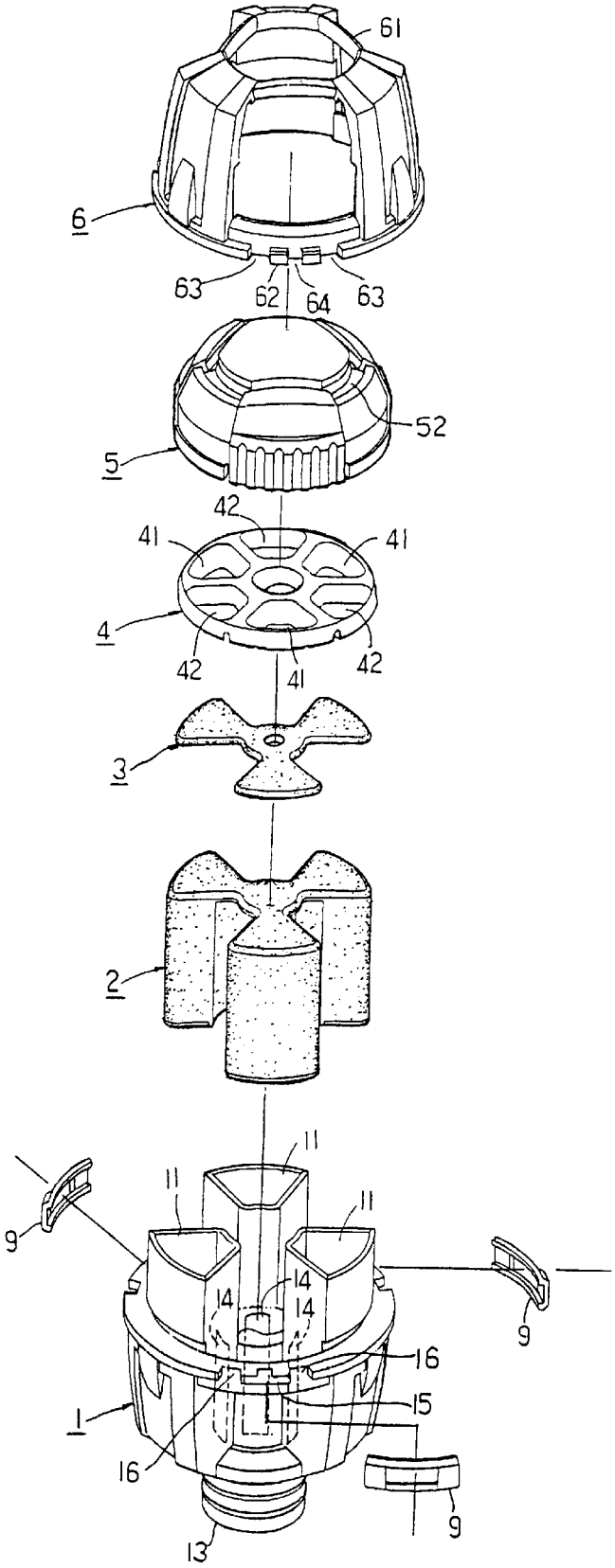
FIG. 2 is an enlarged exploded perspective view of the automatic water stopper of FIG. 1.

Please refer to FIG. 1 that is an exploded perspective view of an automatic water stopper for snorkel according to the present invention, and to FIG. 2 that is an enlarged exploded perspective view of the automatic water stopper shown in FIG. 1. As shown, the automatic water stopper mainly includes from bottom to top a lower case 1, a float 2 having a radiated cross section, a water-stopping diaphragm 3 having a radiated cross section corresponding to that of the float 2, an air path disk 4, an upper hood 5, and an upper case 6.

The lower case 1 is internally provided with a plurality of radially equally spaced upright air tubes 11. In the illustrated drawings, three radially spaced air tubes 11 are provided in the lower case 1. Spaces in the lower case 1 between any two adjacent air tubes 11 together form a float receiving space 12 adapted to receive the float 2 therein. The lower case 1 is provided at a lower central portion with a hose connector 13 downward projected from a bottom of the lower case 1. Each of the air tubes 11 is provided at a lower portion with an opening 14, so that the air tubes 11 are communicable with the tube connector 13 via the openings 14. The hose connector 13 is connected at a lower end to an upper end of a hose 7 forming a body of a snorkel. A mouthpiece holder 8 having a mouthpiece 81 is then connected to a lower end of the hose 7.

The float 2 having a radiated cross section is adapted to locate in the float receiving space 12 in the lower case 1.

The water-stopping diaphragm 3 has a radiated cross section corresponding to that of the float 2 for locating at a top of the float 2.

The air path disk 4 includes a plurality of alternately arranged valve openings 41 and air paths 42. In the illustrated drawings, three valve openings 41 and three air paths 42 are shown. The air paths 42 are aligned with and therefore always communicable with the air tubes 11 of the lower case 1, and accordingly, with the hose connector 13 and the snorkel hose 7 via the openings 14. On the other hand, the valve openings 41 are closed when the radiated float 2 and the radiated water-stopping diaphragm 3 move upward, and are opened when the radiated float 2 and the radiated water-stopping diaphragm 3 move downward. The air path disk 4 is mounted in an internal space of the upper hood 5, so that the valve openings 41 and the air paths 42 are communicable with one another in the upper hood 5.

The upper hood 5 is provided at a top with grooves 52, and the upper case 6 is provided at a top with corresponding ribs 61 for engaging with the grooves 52, so that the upper hood 5 is fitted in the upper case 6. The upper hood 5 and the upper case 6 may be separately produced and assembled together through engagement of the grooves 52 with the ribs 61, or be integrally formed.

After the float 2, the water-stopping diaphragm 3, the air path disk 4, and the upper hood 5 are sequentially assembled and disposed between the lower and the upper case 1, 6, the lower and the upper case 1, 6 may be joined in any suitable means. For example, the lower case 1 may be provided along an upper outer peripheral edge at predetermined positions with spaced lower flanges 15 and two notches 16 at two ends of each lower flange 15, and the upper case 6 is provided along a lower outer peripheral edge at positions corresponding to the lower flanges 15 with spaced upper flanges 62 and two notches 63 at two ends of each upper flange 62. After the above-mentioned components have been mounted between the lower and the upper case 1, 6, a binding ring 9 is put around the lower and upper flanges 15, 62 via the notches 16, 63 to tightly bind the lower and the upper case 1, 6 together. The binding ring 9 may be conveniently dismounted from the lower and the upper case 1, 6 for future maintenance. Moreover, one of the lower and upper cases 1, 6, for example, the lower case 1, may be provided with a tooth 17 while the other case, that is, the upper case 6, may be provided with a dent 64 corresponding to the tooth 17, so that the lower and the upper case 1, 6 may be more securely connected to each other via engagement of the tooth 17 with the dent 64.

Figure 3:
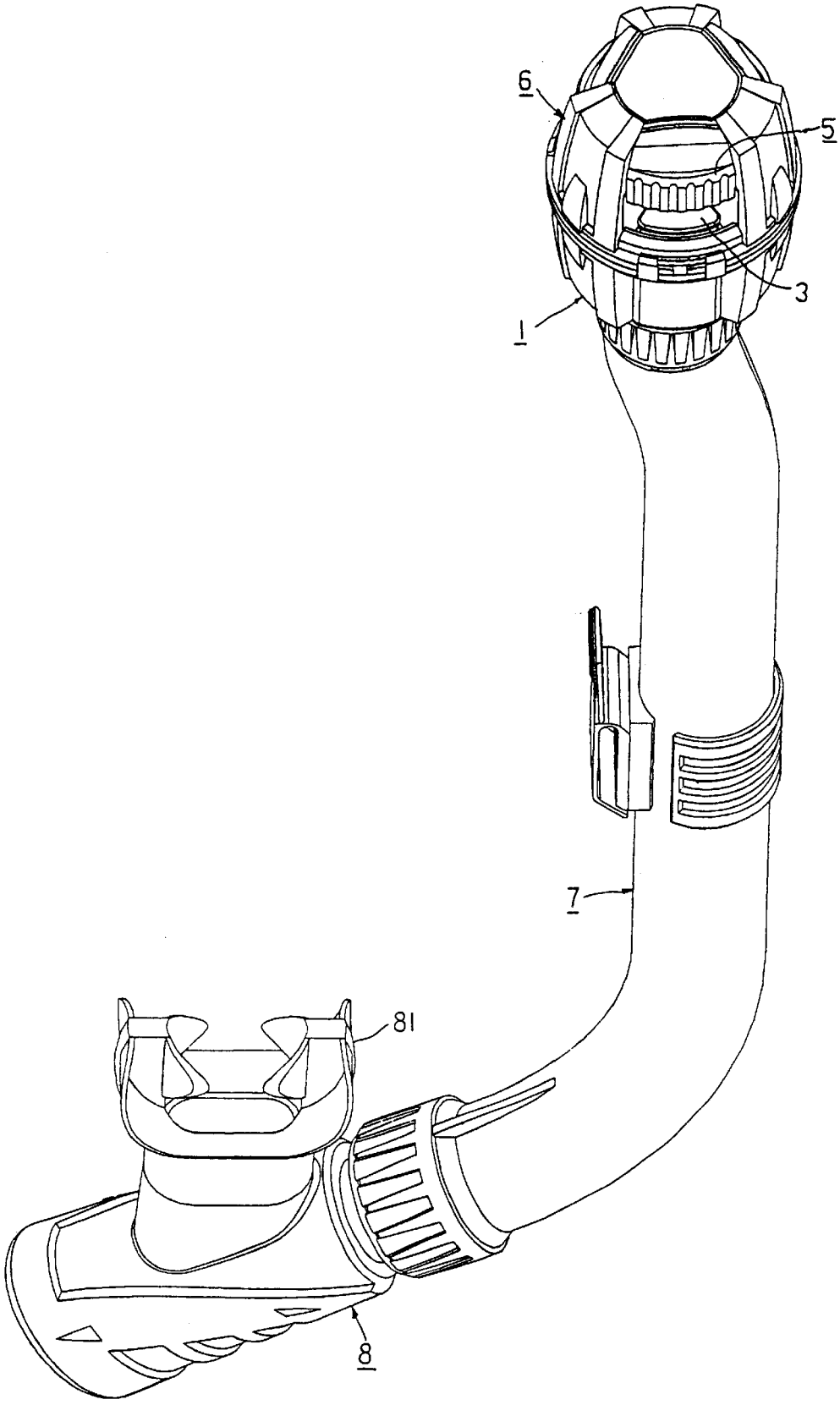
FIG. 3 is an assembled perspective view of the automatic water stopper for snorkel shown in FIG. 1.
Figure 4:
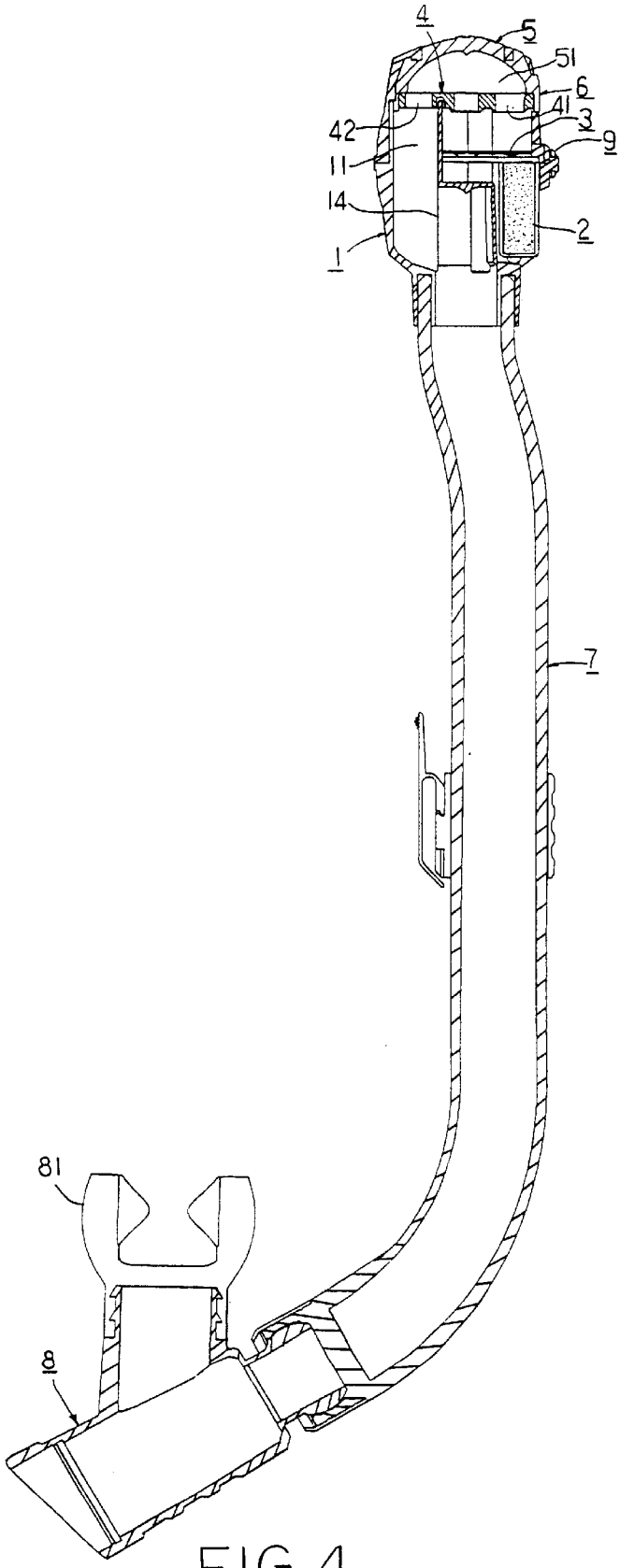
FIG. 4 is a sectional view of FIG. 3.

FIG. 3 is an assembled perspective view of the automatic water stopper for snorkel of the present invention, and FIG. 4 is a sectional view of FIG. 3.

Figure 6:
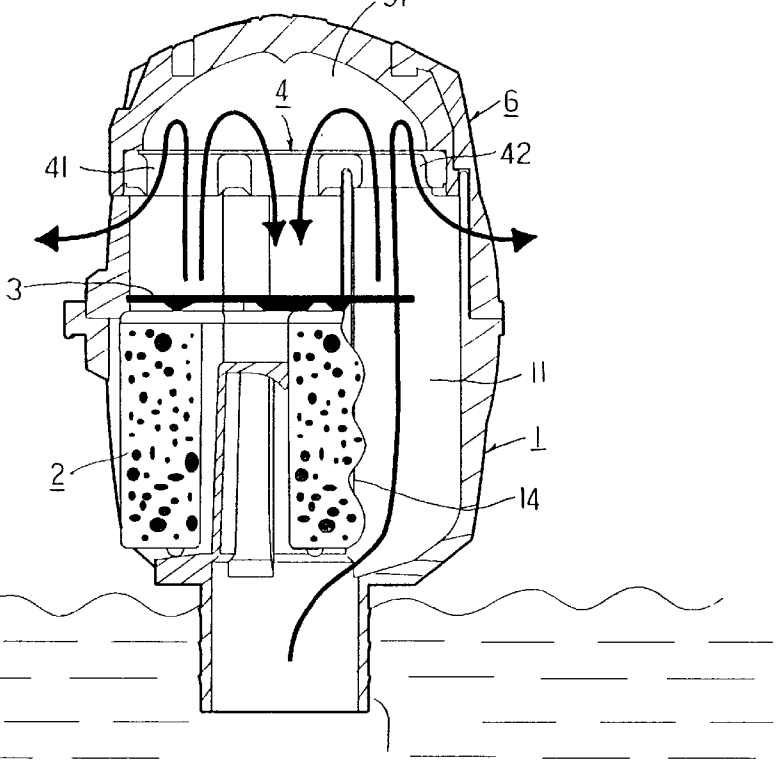
FIG. 6 is a sectional view showing the internal state of the present invention when a user expires.
Figure 5:
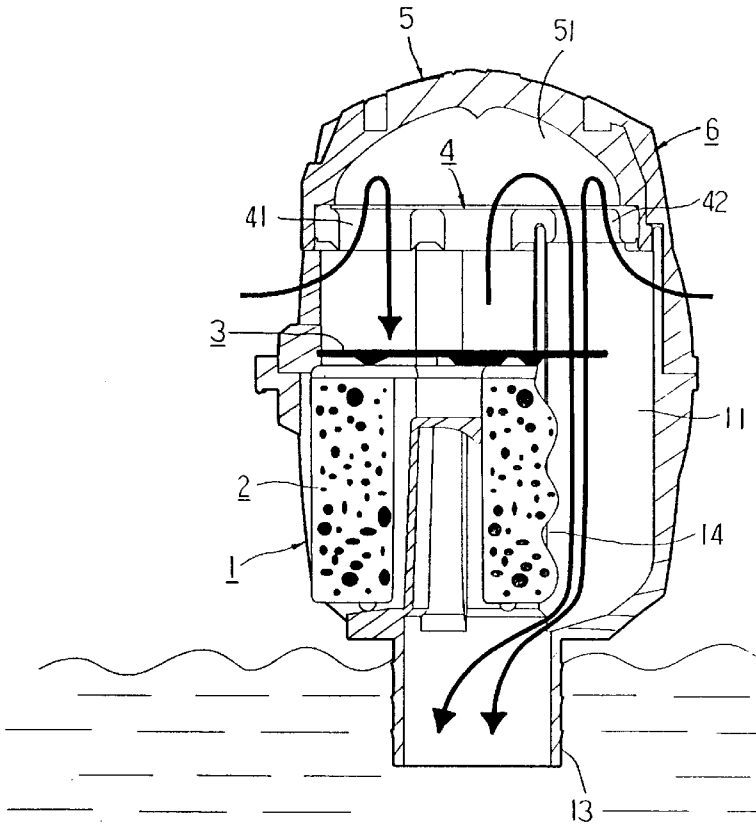
FIG. 5 is a sectional view showing an internal state of the present invention when a user draws in air.

FIGS. 5 and 6 are sectional views showing internal states of the automatic water stopper for snorkel of the present invention when a user draws in and expires air, respectively, via the mouthpiece 81 and the snorkel hose 7. When a skin diver uses a snorkel, the snorkel is substantially perpendicular to a water surface with the automatic water stopper connected to an upper end of the snorkel hose 7 locating above the water surface, and the float 2 and the water-stopping diaphragm 3 on the float 2 are at a lower position in the lower case 1 of the automatic water stopper due to the force of gravity. At this point, the valve openings 41 on the air path disk 4 are open at their bottom side and are communicable with external environments. When the skin diver draws in air, air outside the automatic water stopper flows along the valve openings 41, the internal space 51 of the upper hood 5, the air paths 42, the air tubes 11, the openings 14, the hose connector 13 of the lower case 1, the snorkel hose 7, and the mouthpiece holder 8 to enter into the diver's mouth, as shown in FIG. 5. And, when the diver expires, the expired air flows along the above-described path in a reverse direction and is exhausted from the automatic water stopper, as shown in FIG. 6. The air tubes 11 on the lower case 1 not only serve as one of the air paths for drawing in or exhausting air, their radially equally spaced position in the lower case 1 also enables the lower case 1 and the entire automatic water stopper of the present invention to have a strengthened structure without the risk of being easily damaged or broken due to collision with external things.

Figure 7:
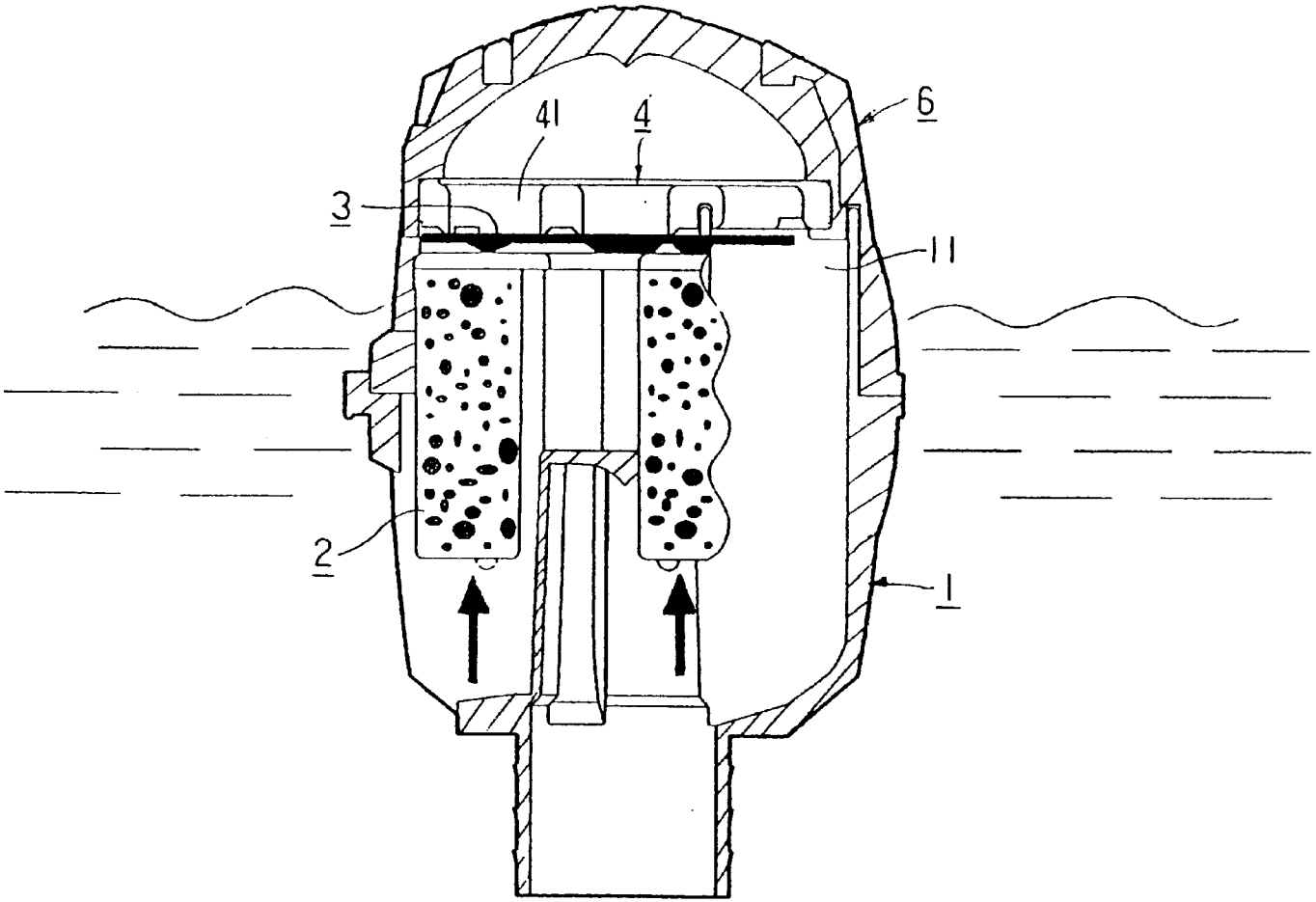
FIG. 7 is a sectional view showing the internal state of the present invention when a float thereof is in contact with water.

There are times a skin diver meets big waves and spindrifts during diving, or it is possible the skin diver inclines his or her head, or when the diver dives into water, and the float 2 at the lower position in the lower case 1 of the automatic water stopper is the first member that contacts with the water. When the float 2 contacts with water, a buoyancy of water causes the float 2 to lift and therefore pushes the water-stopping diaphragm 3 upward. That is, the water-stopping diaphragm 3 would reach the bottom side of the valve openings 41 before the water reaches the valve openings 41. Thus, the water is stopped from entering into the inner space 51 of the upper hood 5 via the valve openings 41. FIG. 7 shows an internal state of the automatic water stopper of the present invention when the float 2 is in contact with water. The float 2 automatically closes the valve openings 41 when it contacts with water and thereby prevents water from flowing into the snorkel hose 7 and the diver's mouth or even bronchial tubes via the valve openings 41.

As can be seen from FIG. 2, the water-stopping diaphragm 3 is provided with at least one air convection hole 31. When the valve openings 41 are closed and the automatic water stopper returns to a higher or upright position for the float 2 to locate above the water surface again, the float 2 would immediately lower due to gravity thereof. At this point, air flows through the air convection hole 31 to separate the water-stopping diaphragm 3 from the air path disk 4, preventing the water-stopping diaphragm 3 from attaching to the bottom side of the air path disk 4 due to a vacuum suction between the two components. That is, the provision of the air convection hole 31 enables the water-stopping diaphragm 3 to lower along with the float 2 when the water surface is lower than a bottom of the float 2, and the valve openings 41 are therefore opened again.

Instead of being an integral body having a radiated cross section, the float 2 and the water-stopping diaphragm 3 may be otherwise formed from a plurality of independent bodies, such as three radially equally spaced float bodies and three radially equally spaced water-stopping diaphragm bodies corresponding to the three float bodies, so that each float body and its corresponding water-stopping diaphragm body independently control the open and close of an individual valve opening 41. An advantage of the radially equally spaced float bodies and water-stopping diaphragm bodies is that one of the valve openings 41 being closed when its corresponding float body is in contact with water due to an inclined snorkel hose 7 would not cause close of other valve openings 41 by the float bodies at the same time. That is, when the automatic water stopper of the present invention has a certain part located below the water surface, only the valve opening 41 corresponding to that part is closed and the valve openings 41 at other parts of the automatic water stopper are not affected and keep open. Therefore, with a snorkel provided with the automatic water stopper of the present invention, a skin diver is able to continuously draw in fresh air without the risk of being choked with water flown into the snorkel hose 7 via the automatic water stopper of the present invention.

What is claimed is:

1. An automatic water stopper for snorkel, comprising:

a lower case being internally provided with a plurality of radially equally spaced upright air tubes, such that spaces in said lower case between any two said air tubes adjacent to each other together form a float receiving space; said lower case being provided at a lower central portion with a hose connector downward projected from a bottom of said lower case, each of said air tubes being provided at a lower portion with an opening, via which said air tubes are communicable with said tube connector; said hose connector being connected at a lower end to an upper end of a hose of a snorkel, and a lower end of said hose of said snorkel having a mouthpiece holder connected thereto;

a float having a radiated cross section being adapted to locate in said float receiving space in said lower case;

a water-stopping diaphragm having a radiated cross section corresponding to that of said float for locating at a top of said float;

an air path disk including a plurality of alternately arranged valve openings and air paths, said air paths being aligned with and therefore always communicable with said air tubes of said lower case, and accordingly, with said hose connector and said snorkel hose via said openings on said air tubes; said valve openings being closed when said radiated float and said radiated water-stopping diaphragm are at an upper position in said lower case, and being opened when said radiated float and said radiated water-stopping diaphragm are at a lower position in said lower case;

an upper hood defining an internal space, to a lower side of which said air path disk is mounted, such that said valve openings and said air paths on said air path disk are communicable with one another in said internal space of said upper hood; and an upper case being put over said upper hood to connect at a lower peripheral edge to an upper peripheral edge of said lower case.

2. The automatic water stopper for snorkel as claimed in claim 1, wherein said upper hood and said upper case are integrally formed.

3. The automatic water stopper for snorkel as claimed in claim 1, wherein said upper hood and said upper case are separately produced and then assembled to each other.

4. The automatic water stopper for snorkel as claimed in claim 3, wherein said upper hood is provided at a top with grooves, and said upper case being provided at a top with ribs corresponding to and engaging with said grooves on said upper hood.

5. The automatic water stopper for snorkel as claimed in claim 1, wherein said lower case is provided along said upper outer peripheral edge at predetermined positions with spaced lower flanges and two notches at two ends of each said lower flange, and said upper case being provided along said lower outer peripheral edge at positions corresponding to said lower flanges with spaced upper flanges and two notches at two ends of each said upper flange; and said lower and said upper case being joined together by putting a binding ring around said lower and upper flanges via said notches.

6. The automatic water stopper for snorkel as claimed in claim 5, wherein one of said upper and said lower flanges is provided with a tooth, and another lower or upper flange corresponding to said flange provided with a tooth is provided with a dent corresponding to said tooth, such that said tooth and said dent engage with each other when said upper and said lower case are joined together.

7. The automatic water stopper for snorkel as claimed in claim 1, wherein said float and said water-stopping diaphragm include a plurality of radially equally spaced float bodies and a plurality of radially equally spaced diaphragm bodies, respectively, so that each said float body and one said water-stopping diaphragm body corresponding to said float body independently control open and close of an individual valve opening on said air path disk.

8. The automatic water stopper for snorkel as claimed in claim 1, wherein said water-stopping diaphragm is provided with at least one air convection hole.

9. The automatic water stopper for snorkel as claimed in claim 7, wherein each of said water-stopping diaphragm bodies is provided with at least one air convection hole.

* * * * *